United States Patent [19]

Schlosser

[11] Patent Number: 4,570,266

[45] Date of Patent: Feb. 18, 1986

[54] STRAND GARMENT AND METHOD OF FABRICATING SAME

[76] Inventor: Cynthia M. Schlosser, 173 Meador Way, SE, Atlanta, Ga. 30315

[21] Appl. No.: 705,021

[22] Filed: Feb. 25, 1985

[51] Int. Cl.[4] ..... A41D 3/08; A41D 1/22; A41D 1/04; A41D 1/14

[52] U.S. Cl. ..... 2/69; 2/88; 2/74; 2/102; 2/211

[58] Field of Search ..... 2/88, 74, 102, 69, 75, 2/90, 106, 115, 211

[56] References Cited

U.S. PATENT DOCUMENTS 780,945 1/1905 Fenton .
1,045,173 11/1912 Peck .
1,729,817 10/1929 Bullard .
2,546,563 3/1951 Rodin et al. ..... 2/211
2,763,868 9/1956 Grabill ..... 2/88
4,004,296 1/1977 Kandel ..... 2/211

*Primary Examiner*—Ronald Feldbaum
*Attorney, Agent, or Firm*—Thomas & Kennedy

[57] ABSTRACT

Garments are made of sets 11–14 of loosely juxtaposed strands of yarn that are spread to a single layer and stitched to tapes 16,17 at each of their ends and are bundled together intermediate their ends and stitched to a central tape 15, with the sets of strands and tapes comprising a segment of a garment.

10 Claims, 9 Drawing Figures

STRAND GARMENT AND METHOD OF FABRICATING SAME

TECHNICAL FIELD

This invention relates generally to clothing and to methods of manufacturing clothing.

BACKGROUND OF THE INVENTION

Custom made garments have always been expensive since they must be hand tailored to fit individuals. Even "off the shelf" garments can be expensive today due to the costs of woven fabric, tailoring and stitching plus the fact that numerous sizes must be manufactured for any one style. Retail merchants also incur the costs of size adjustments for off the shelf garments. As a result, today most people must spend a significant portion of their income on clothing. Thus, were a new type of garment to be devised that is inexpensive to manufacture and which provided the wearer with a pleasing and stylish appearance, and which can be worn in different attitudes on the body, a definitive advance in the art would be achieved. It is to the provision of such a garment that the present invention is primarily directed.

SUMMARY OF THE INVENTION

Briefly described, the present invention comprises a garment formed from a set of loosely juxtaposed strands of yarn of approximately equal length which are arranged generally parallel to one another and are bound together along first and second seams located adjacent opposite strand ends. The set of bound strands is adapted to be draped upon and cover a portion of a human body. By assembling more than one set of the bound strands or by attaching ties to a single set of bound strands, various types of garments such as dresses, capes, bustles, vests, and halters may be fabricated. In some embodiments, the sets of bound strands are bundled together intermediate their ends so that the sets of strands fan out from the middle of the set toward the ends of the set.

In another form of the invention a method of fabricating a garment comprises the steps of arranging a plurality of yarn strands together in a parallel arrangement and forming a seam at each end of the arrangement of strands to connect the strands together in a curtain-like shape with the strands extending loosely side by side. Also, the strands can be gathered into a bundle at a position intermediate the strand ends.

Thus, it is an object of this invention to provide a new garment structure that is inexpensive to produce yet is fashionable and capable of being worn in several arrangements about the body.

Another object of this invention is to provide garments that are formed from garment segments which comprise a plurality of yarn strands approximately of the same length arranged generally parallel to one another and connected to one another only at opposite ends of the strands and optionally bundled together intermediate their ends.

Other objects, features and advantages of the invention will become apparent upon reading the following specifications, when taken in conjunction with the accompanying drawings.

DETAILED DESCRIPTION

Figure 1:
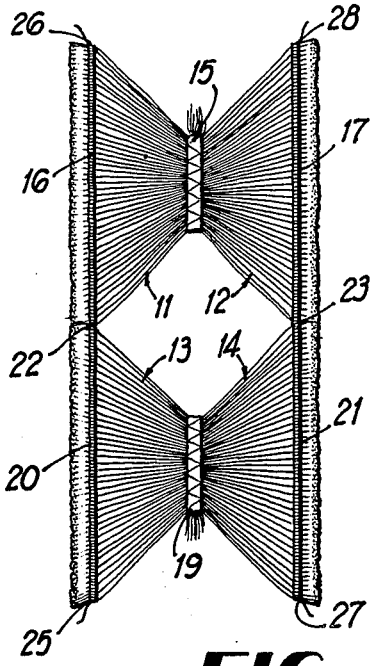
FIG. 1 is a plan view of a vest embodying principles of the invention in a partial state of completion with the vest shown laid out upon a flat surface.
Figure 2:
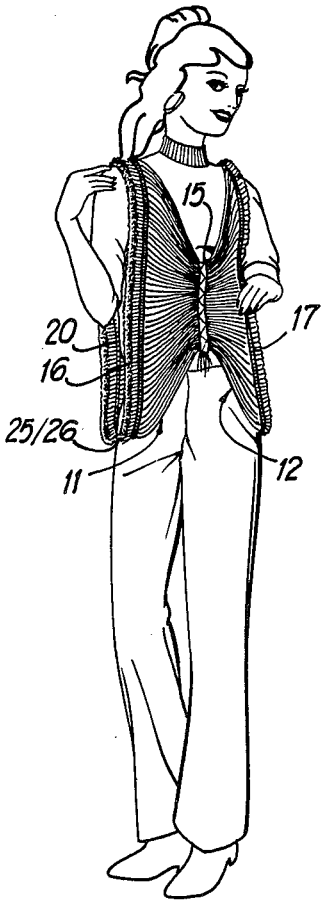
FIG. 2 is a front view of the vest illustrated in FIG. 1 shown in a completed state being worn.

Referring now in more detail to the drawing, in which like numerals indicate like parts in the several views, FIGS. 1 and 2 illustrate a vest having two distinct sets or groups of strands, the first group indicated at 11, 12 and the second group indicated at 13, 14. The sets of strands are formed of individual yarn strands of approximately the same length and arranged generally parallel to one another. The strands are spread at their ends into a single layer, and tapes or seams are sewn to the end portions of the strands. More specifically, tapes 16 and 17 are sewn to the ends of the strands of the group 11, 12, with the tapes extending approximately at a right angle to the strands. Also, the strands are bundled together intermediate their ends and bound by tape 15, with tape 15 sewn to the strands. In this manner the strands that comprise the set are generally juxtaposed to extend loosely from one tape to the other in side-by-side relationship.

With continued reference to FIGS. 1 and 2, the set of strands 13 and 14 is formed in the same way as the set 11, 12 in that the strands are bundled together intermediate their ends and sewn to tape 19. The opposite end portions of the strands are stitched less densely to tapes 20 and 21, respectively. One end of tape 20 is sewn to the end of tape 16 at attachment point 22 while one end of tape 21 is similarly sewn to an end of tape 17 at attachment point 23. An end 25 of tape 20 is also attached to an end 26 of tape 16 while an end 27 of tape 21 is attached to an end 28 of tape 17 to complete the vest. Thus, each set of strands and its tapes form a garment segment, with the garment segments being attached together to form the garment illustrated in FIG. 2.

After the vest is finished it may be worn on a person as shown in FIG. 2 with set of strands 11, 12 providing the vest front and the set 13, 14 providing the vest back. In this embodiment it is not the extreme end of the strands that are attached to the tapes 16, 17, 20, 21, but rather the tapes are sewn to the end portions of the strands located closely adjacent to the extremities. Thus, for the purpose of this application the term strand ends is meant to includes areas or regions of the strands located at least close to strand extremities.

Figure 4:
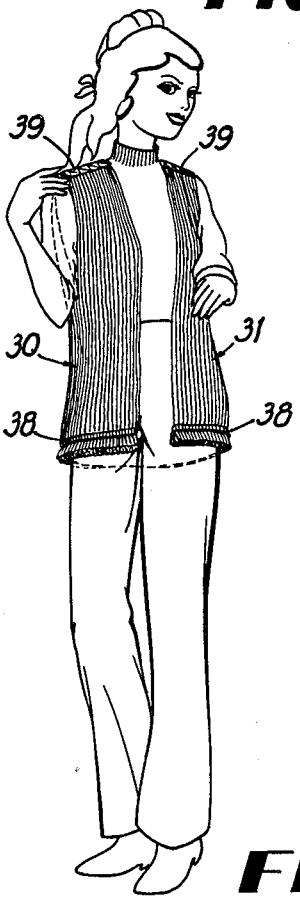
FIG. 4 is a perspective view of the cape illustrated in FIG. 3 shown being worn.
Figure 3:
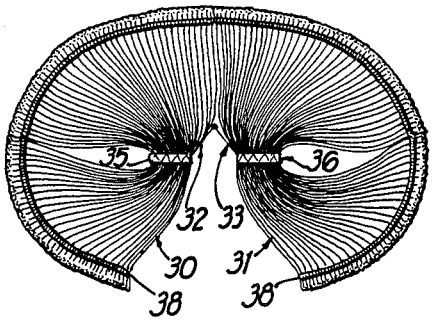
FIG. 3 is a plan view of a cape embodying principles of the invention shown laid out upon a flat surface.

With reference next to FIGS. 3 and 4, a cape embodying principles of the invention, also made in accordance with the method of the invention, includes two sets or groups of yarn strands 30, 31, and 32, 33. The sets of strands are constructed in an arrangement that is substantially a duplicate of the garment segments of FIGS. 1 and 2, in that the strands are bunched relatively densely intermediate their ends and sewn to central tapes 35 and 36. The opposite ends of the sets of strands are sewn to one long tape 38 which is seen in FIG. 3 almost to encircle the other two tapes 32 and 33 which here are positioned in mutual alignment. Thus, the tape 38 has a length several times greater than that of the tapes 35 or 36. The sets of strands 30, 32 form one garment segment while the set of strands 31, 33 form another garment segment, with the garment segments being attached by the common tape 38, and the garment formed is a cape as illustrated in FIG. 4. The cape may be draped over the shoulders of a person with tapes 35 and 36 supported upon the shoulders as shown in FIG. 4, where two decorative shoulder epaulets 29 are attached along the seams.

Figure 5:
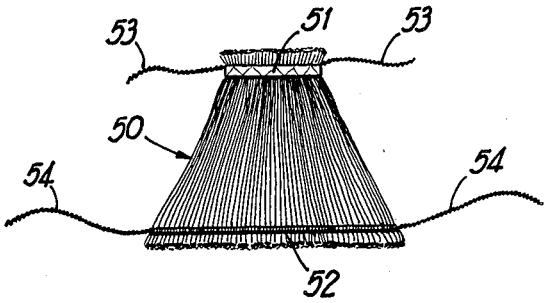
FIG. 5 is a plan view of a halter shown laid out upon a flat surface.
Figure 6:
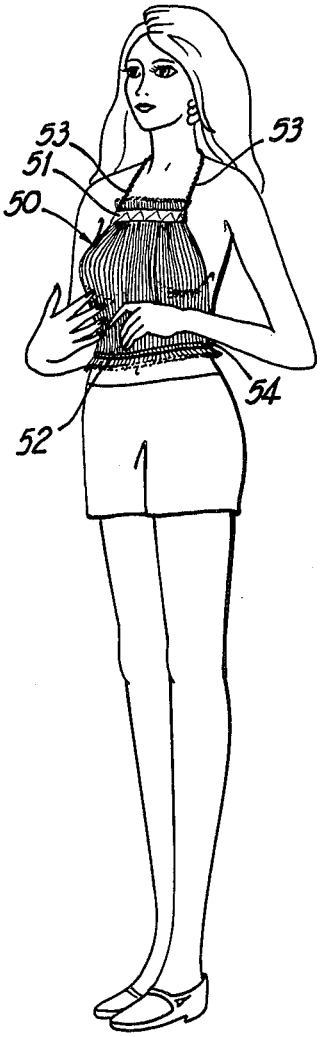
FIG. 6 is a perspective view of the halter illustrated in FIG. 5 shown being worn.

With reference next to FIGS. 5 and 6, a halter is shown comprising a set 50 of strands of yarn which are stitched relatively densely together to tape 51 at one of their ends and stitched less densely along another tape 52 located adjacent their other ends. Ties 53 are secured to opposite ends of tape 51 while ties 54 are attached to the opposite ends of seam 52. So constructed, the halter may be worn as shown in FIG. 6.

Figure 7:
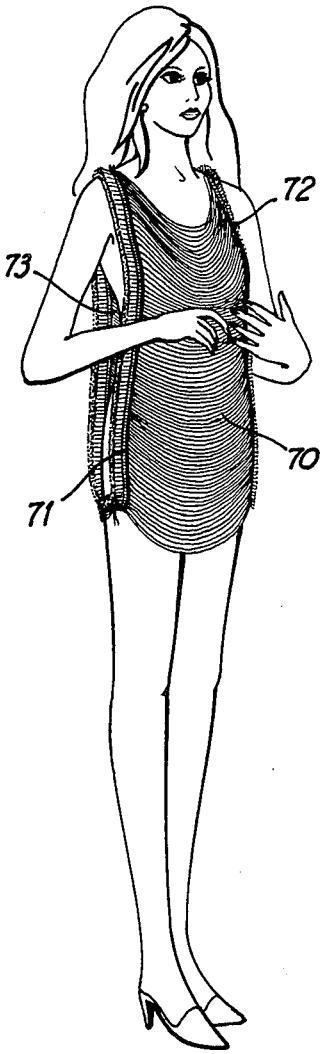
FIG. 7 is a front view of a dress embodying principles of the invention shown being worn.

With reference next to the embodiment illustrated in FIG. 7, a dress is formed which embodies the principles of the invention in yet another form. Here, the dress includes duplicate garment segments, one segment forming the front of the dress and the other forming the back of the dress. As illustrated in FIG. 7, a front set 70 of loose strands of yarn which are draped generally horizontally and attached at opposite ends to vertical, front tapes 71 and 72. Similarly, the dress has a rear set 73 of strands of yarn which also are attached at opposite ends to two vertical, rear tapes. The opposite ends of the front tapes of the front segment are secured to opposite ends of the tapes of the rear segment, as shown.

Figure 8:
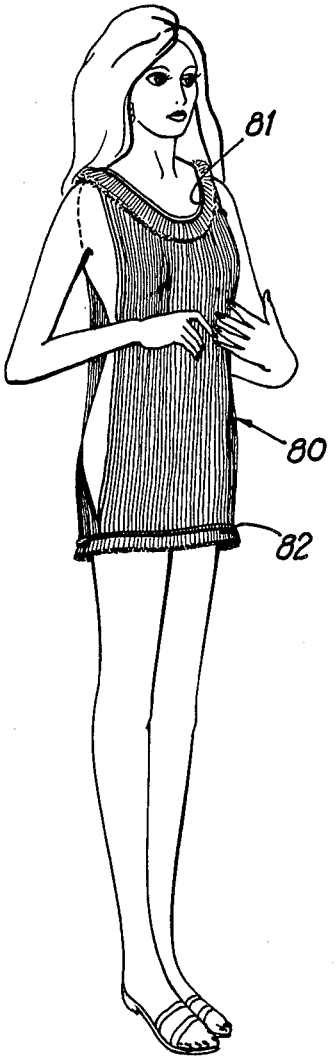
FIG. 8 is a front view of a dress embodying other principles of the invention shown being worn.

In FIG. 8 another dress is shown with strands of yarn that are draped vertically instead of generally horizontally as in the case of the dress shown in FIG. 7. Here, the dress comprises a front set 80 of strands of yarn which are attached at opposite ends to tapes 81 and 82 to form a front garment segment. A rear garment segment of the same construction is also provided with is hidden from view in this particular figure. The back and front pieces are attached together at the extremities of the tapes 81 and 82.

Figure 9:
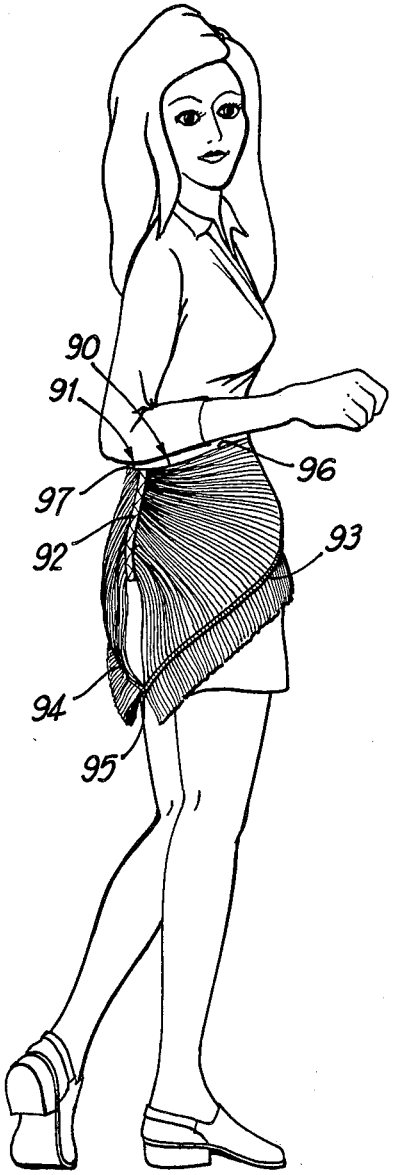
FIG. 9 is a perspective view of a bustle embodying principles of the invention shown being worn.

Finally, with reference to FIG. 9 a bustle is illustrated which has one set of strands 90, 91 that is bundled and sewn relatively densely together intermediate their ends with tape 92. The strands are spread apart and sewn at one common end to tape 93, and are spread apart and sewn at their other common end to tape 94. One end of each of the tapes 93 and 94 are attached together at attachment point 95. The bustle is also provided with ties 96 and 97 which are also sewn to central tape 92 and end tapes 93 and 94 and extended around the front of the person and tied together when wearing the bustle.

The embodiments of the invention of FIGS. 1–9 illustrate that a new garment and method of fabricating a garment is provided which not only is of a unique, striking design but which comprises a garment structure that can be formed in prefabricated segments, with the segments capable of forming different kinds of garments. This results in low manufacturing costs. Many types of garments in addition to those particularly illustrated in the drawing can be made with segments or sets of bound strands of yarn as described herein, thus substantially reducing the cost of fabrication. The unique structure of garments with juxtaposed strands of yarn that are not attached but are held loosely together enables the garments to be draped from a human body in such a manner that a single garment may fit several sizes without appearing to be misfitted. Though the strands are loose, the garments nevertheless are good thermal insulators. The cost of the material and the simplicity of the manufacturing method also enables the garments to be produced at a relatively low cost.

It should be understood that the just described embodiments merely illustrate the principles of the invention in several, preferred forms. Many modifications, additions and deletions may, of course, be made thereto without departure from the spirit and scope of the invention as set forth in the following claims.

I claim:

1. A garment comprising at least two garment segments attached together to form the garment, each said segment comprising a plurality of strands approximately of the same length assembled generally parallel to one another with the end portions of the strands arranged in one layer, first tape means connecting together one end portion of the strands and second tape means connecting together the other end portion of the strands, said strands being arranged in a bundle intermediate their ends, and means bundling together the strands intermediate their ends.

2. The garment of claim 1 and wherein the segments of said garment are connected together at the ends of their tape means.

3. The garment of claim 1 and wherein the tape means at opposite end portions of one segment are connected together.

4. A garment including garment segments each comprising a set of loosely juxtaposed strands of yarn bound together along first and second seams located adjacent opposite strand ends, said garment segments being adapted to be draped upon and cover a portion of a human body.

5. A garment in accordance with claim 4 wherein said garment segments are attached at the ends of said seams.

6. A garment in accordance with claim 5 wherein one garment segment forms a vest front and a second garment segment forms a vest back.

7. The garment in accordance with claim 4 wherein each garment has its strands of yarn bundled together intermediate their ends.

8. A garment in accordance with claim 4 and wherein two of said garment segments are attached at opposite ends of their first and second seams.

9. A garment comprising a set of loosely juxtaposed strands of yarn, tape means attaching the strands together at opposite ends thereof, and means for suspending said set of strands from a human body.

10. The garment in accordance with claim 9 and wherein said strands are of substantially the same length, are arranged in side-by-side generally parallel relationship, and are bundled together intermediate their ends, and wherein at least one end of each tape means are connected together.

* * * * *